US008222555B2

(12) United States Patent
Schaltenbrand et al.

(10) Patent No.: US 8,222,555 B2
(45) Date of Patent: Jul. 17, 2012

(54) CIRCUIT BREAKER AND ARC CHUTE WITH SHIELD APPARATUS

(75) Inventors: Brian John Schaltenbrand, Pittsburgh, PA (US); Mark Anthony Janusek, Pittsburgh, PA (US); Ronald William Brand, Jr., Beaver Falls, PA (US); James Michael Smeltzer, Salem, OH (US)

(73) Assignee: Eaton Corporation, Cleveland, OH (US)

( * ) Notice: Subject to any disclaimer, the term of this patent is extended or adjusted under 35 U.S.C. 154(b) by 123 days.

(21) Appl. No.: 12/857,721

(22) Filed: Aug. 17, 2010

(65) Prior Publication Data

US 2012/0043302 A1 Feb. 23, 2012

(51) Int. Cl.
*H01H 9/36* (2006.01)

(52) U.S. Cl. ..... 218/34; 218/157

(58) Field of Classification Search ..... 439/156–158, 439/34, 38

See application file for complete search history.

(56) References Cited

U.S. PATENT DOCUMENTS

| | | | | |
|---|---|---|---|---|
| 4,950,852 | A | 8/1990 | Goldman et al. | |
| 5,589,672 | A * | 12/1996 | Uchida et al. | 218/34 |
| 6,207,916 | B1 * | 3/2001 | Pniok et al. | 218/1 |
| 7,034,242 | B1 * | 4/2006 | Shea et al. | 218/157 |
| 7,186,941 | B2 * | 3/2007 | Yeon | 218/38 |
| 7,488,915 | B2 * | 2/2009 | Pollitt et al. | 218/149 |
| 2005/0263492 | A1 | 12/2005 | McCoy | |

FOREIGN PATENT DOCUMENTS

CN 2762330 Y 3/2006

OTHER PUBLICATIONS

European Patent Office, "European search report", Dec. 7, 2011, 7 pp.

* cited by examiner

*Primary Examiner* — Truc Nguyen
(74) *Attorney, Agent, or Firm* — Eckert Seamans Cherin & Mellott, LLC; Brij K. Agarwal

(57) ABSTRACT

An improved circuit breaker and arc chute has a shield apparatus that includes a number of plate-like shield members that have elongated openings formed therein to receive portions of arc plates therethrough. The portions of the arc plates that pass through the shield member are received in receptacles of a support apparatus that supports the arc plates. The arc plates are themselves configured to retain the shield members against the support apparatus to protect the support apparatus from damage in the event of an electrical arc. Advantageously, the retention of the shield members between portions of the arc plates and portions of the support apparatus enables the shield members to be held in place without the use of adhesives or separate fastening systems.

16 Claims, 4 Drawing Sheets

44
4
52
44
46
28
84
80
76
48
16
14B
14A
60
56
72
20
32
40
68

46
14D
56
14C
68
72
14C
92

36
28

CIRCUIT BREAKER AND ARC CHUTE WITH SHIELD APPARATUS

BACKGROUND

1. Technical Field

The disclosed and claimed concept relates generally to circuit interrupters and, more particularly, to a circuit interrupter having an arc chute that includes a shield apparatus.

2. Related Art

Numerous types of circuit interrupters such as circuit breakers are generally known in the relevant art. Such circuit interrupters are intended to interrupt current in a circuit during certain overcurrent and under-voltage conditions and other conditions.

When the separable contacts of a circuit interrupter are opened, an electrical arc often propagates between the separating contacts. Since such arcs are destructive to the circuit interrupter, they preferably are extinguished as quickly as possible. It thus has been known to provide arc chutes and other arc extinguishing and elimination systems in circuit interrupters for the purpose of limiting the damage that is caused by such arcs. While known arc chutes have been generally effective for their intended purposes, they have not been without limitation.

Known arc chutes typically include a plurality of electrically conductive arc plates and an arc horn that are mounted to a support structure. The support structure may be formed of a nonconductive material such as a molded resin. Since molded resins are very susceptible to damage in the presence of an electrical arc, it has been known to provide arc quenching materials in the vicinity of the arc chute that generate gases in the presence of an arc in order to facilitate the extinguishment of the arc. However, such arc quenching materials are relatively costly and have proven difficult to place in the vicinity of the support structure in a cost efficient fashion that still extinguishes an arc and protects the support structure.

SUMMARY

In view of the foregoing, an improved circuit breaker and arc chute has a shield apparatus that includes a number of plate-like shield members that have elongated openings formed therein to receive portions of arc plates therethrough. The portions of the arc plates that pass through the shield member are received in receptacles of a support apparatus that supports the arc plates. The arc plates are themselves configured to retain the shield members against the support apparatus to protect the support apparatus from damage in the event of an electrical arc. Advantageously, the retention of the shield members between portions of the arc plates and portions of the support apparatus enables the shield members to be held in place without the use of adhesives or separate fastening systems.

Accordingly, an aspect of the disclosed and claimed concept is to provide an improved circuit breaker and arc chute having a shield apparatus that generates gases in the presence of an arc to facilitate the extinguishment of the arc.

Another aspect of the disclosed and claimed concept is to provide an improved circuit breaker and arc chute wherein a shield apparatus is configured to protect a support apparatus of the arc chute without the use of adhesives or separate fastening structures to hold the support apparatus in place.

Other aspects of the disclosed and claimed concept are provided by an improved arc extinction apparatus for use in a circuit interrupter, wherein the general nature of the arc extinction apparatus can be generally stated as including a plurality of arc plates, a support apparatus, and at least a first shield member structured to generate gases in the presence of an electrical arc, wherein at least a portion of at least some of the arc plates are engaged with the at least first shield member to retain the at least first shield member between the at least portion of the at least some of the arc plates and at least a portion of the support apparatus.

Still other aspects of the disclosed and claimed concept are provided by an improved circuit interrupter, the general nature of which can be stated as including a line terminal, a load terminal, a set of separable contacts, and an arc extinction apparatus. The arc extinction apparatus can be generally stated as including a plurality of arc plates, a support apparatus, and at least a first shield member structured to generate gases in the presence of an electrical arc, wherein at least a portion of at least some of the arc plates are engaged with the at least first shield member to retain the at least first shield member between the at least portion of the at least some of the arc plates and at least a portion of the support apparatus.

BRIEF DESCRIPTION OF THE DRAWINGS

A further understanding of the disclosed and claimed concept can be gained from the following Description when read in conjunction with the accompanying drawings in which:

Similar numerals refer to similar parts throughout the specification.

DESCRIPTION

Figure 1:
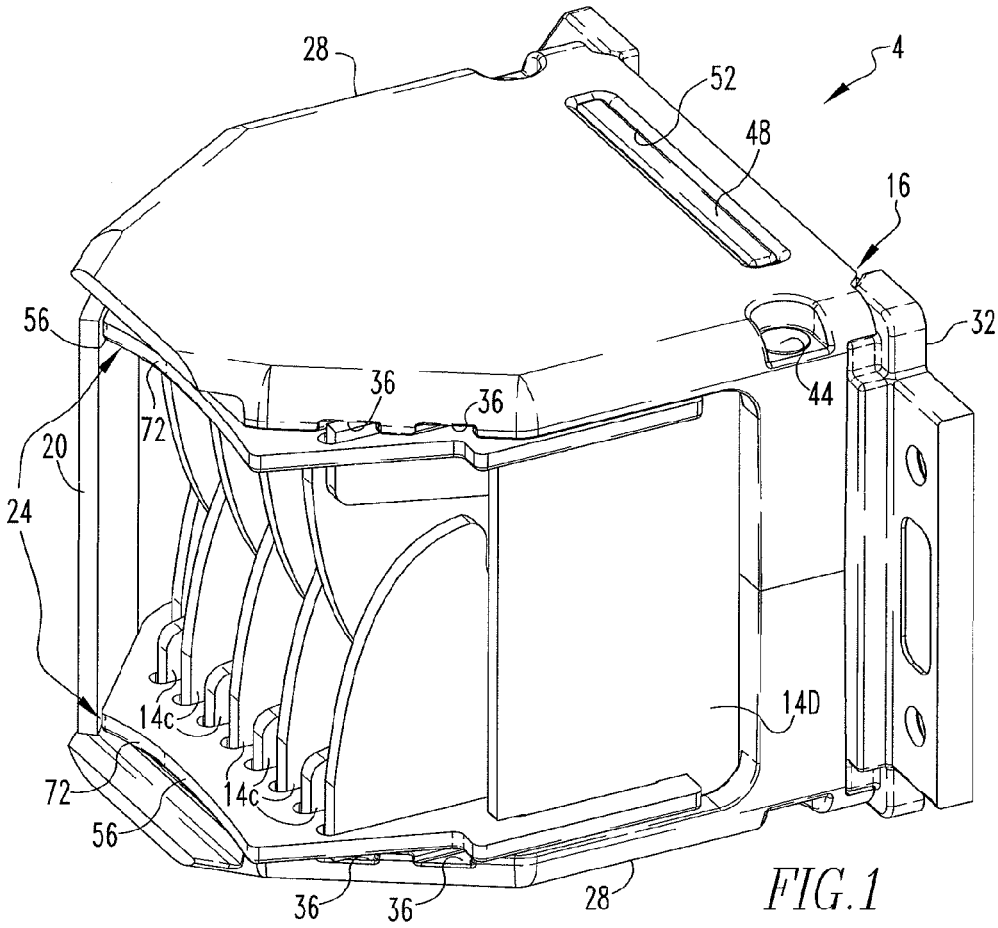
FIG. 1 is a perspective view of an improved arc chute in accordance with the disclosed and claimed concept.
Figure 2:
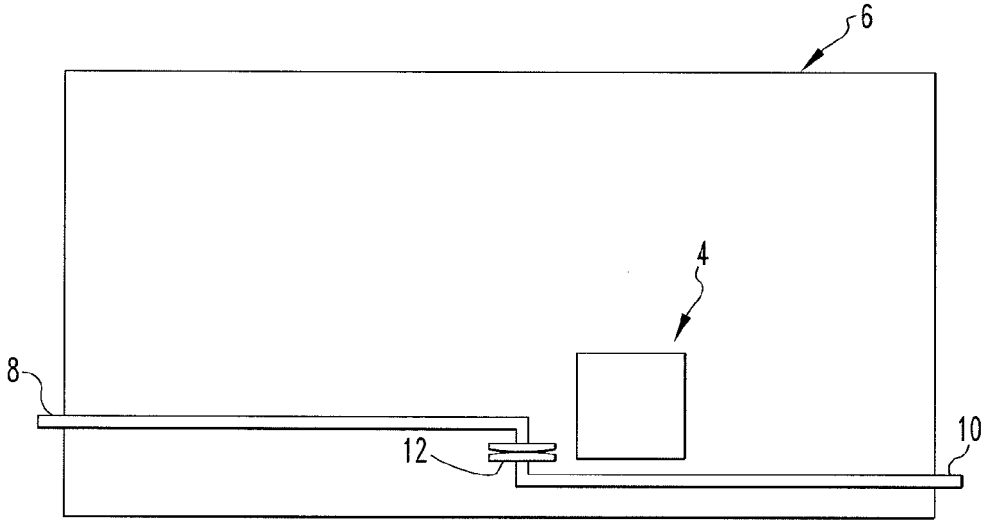
FIG. 2 is a schematic depiction of an improved circuit breaker that includes the improved arc chute of FIG. 1.

An improved arc chute 4 in accordance with the disclosed and claimed concept is depicted generally in FIGS. 1 and 3-5, and is depicted schematically in FIG. 2. The arc chute 4 can be used in a circuit interrupter such as an improved circuit breaker 6, which is depicted schematically in FIG. 2. The improved circuit breaker 6 includes a line terminal 8 and a load terminal 10 that are connected by a set of separable contacts 12. The circuit breaker 6 additionally includes the improved arc chute 4 in the vicinity of the separable contacts 12 in order to expeditiously extinguish any arc that might be propagated during an arc event that may occur contemporaneous with separation of the set of separable contacts 12.

Figure 3:
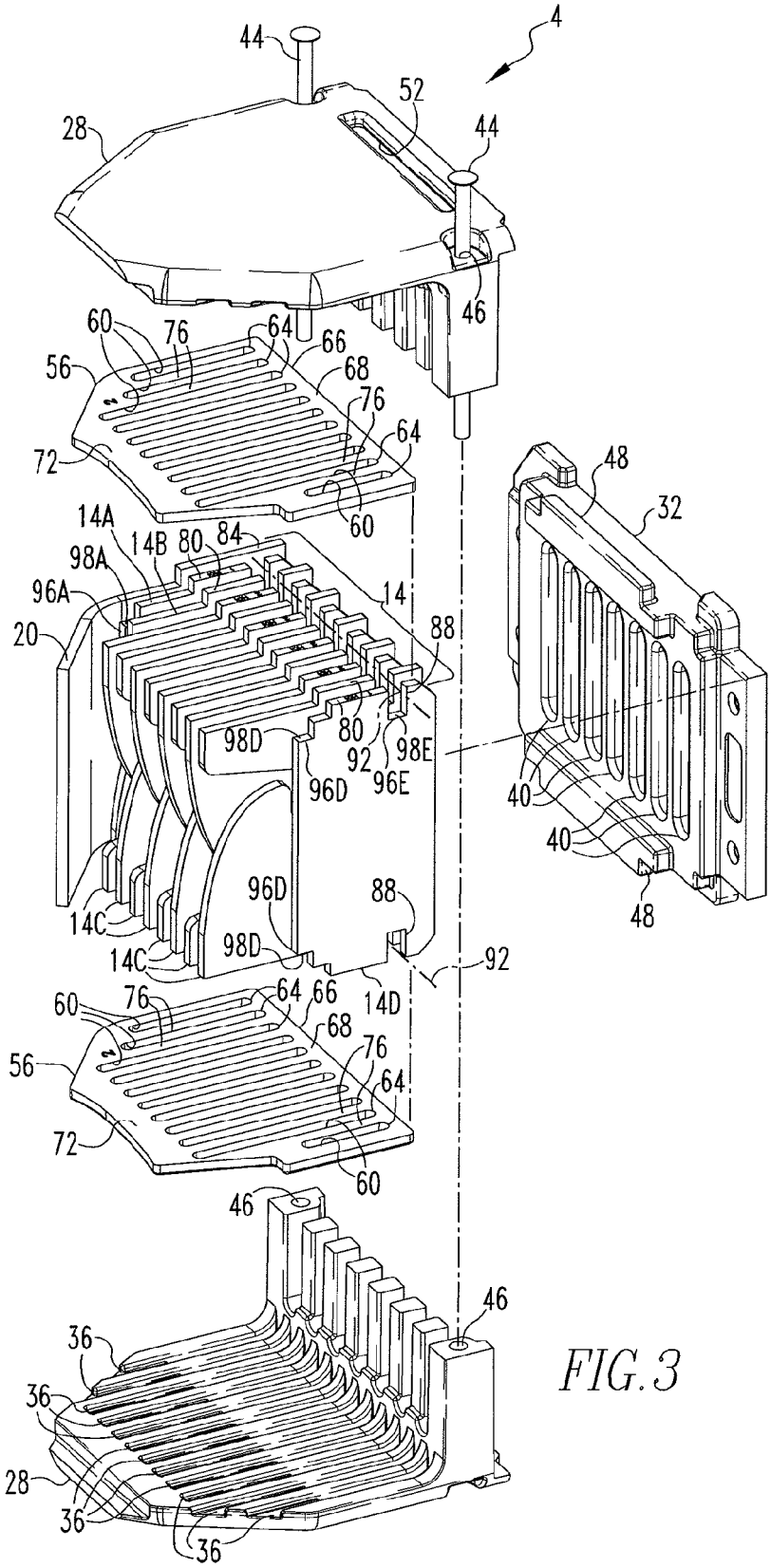
FIG. 3 is an exploded view of the arc chute of FIG. 1.
Figures 4, 5:
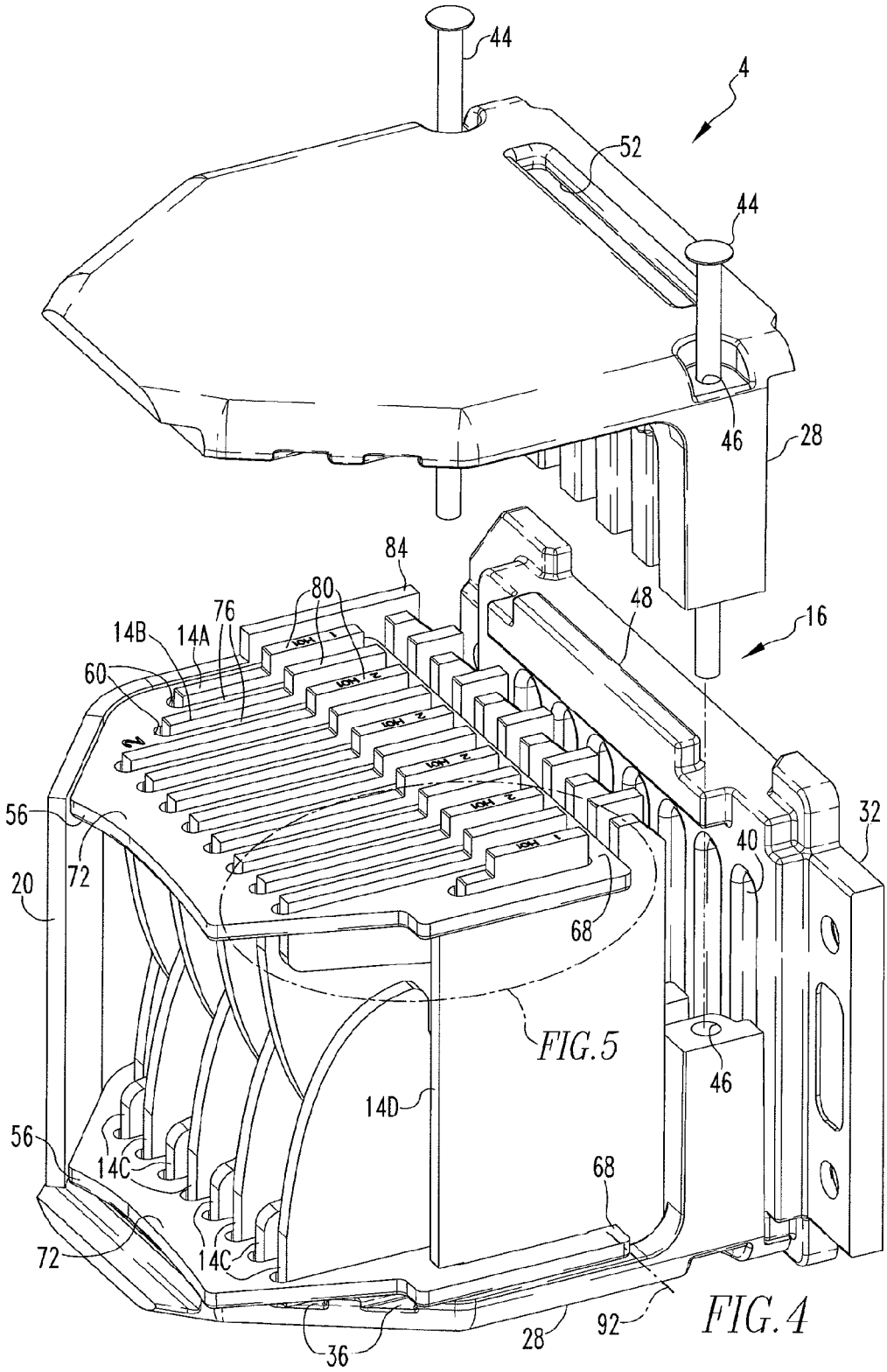
FIG. 4 is another exploded view of the arc chute of FIG. 1.
FIG. 5 is a view of the encircled portion of FIG. 4, partially cut away.
Figure 5:
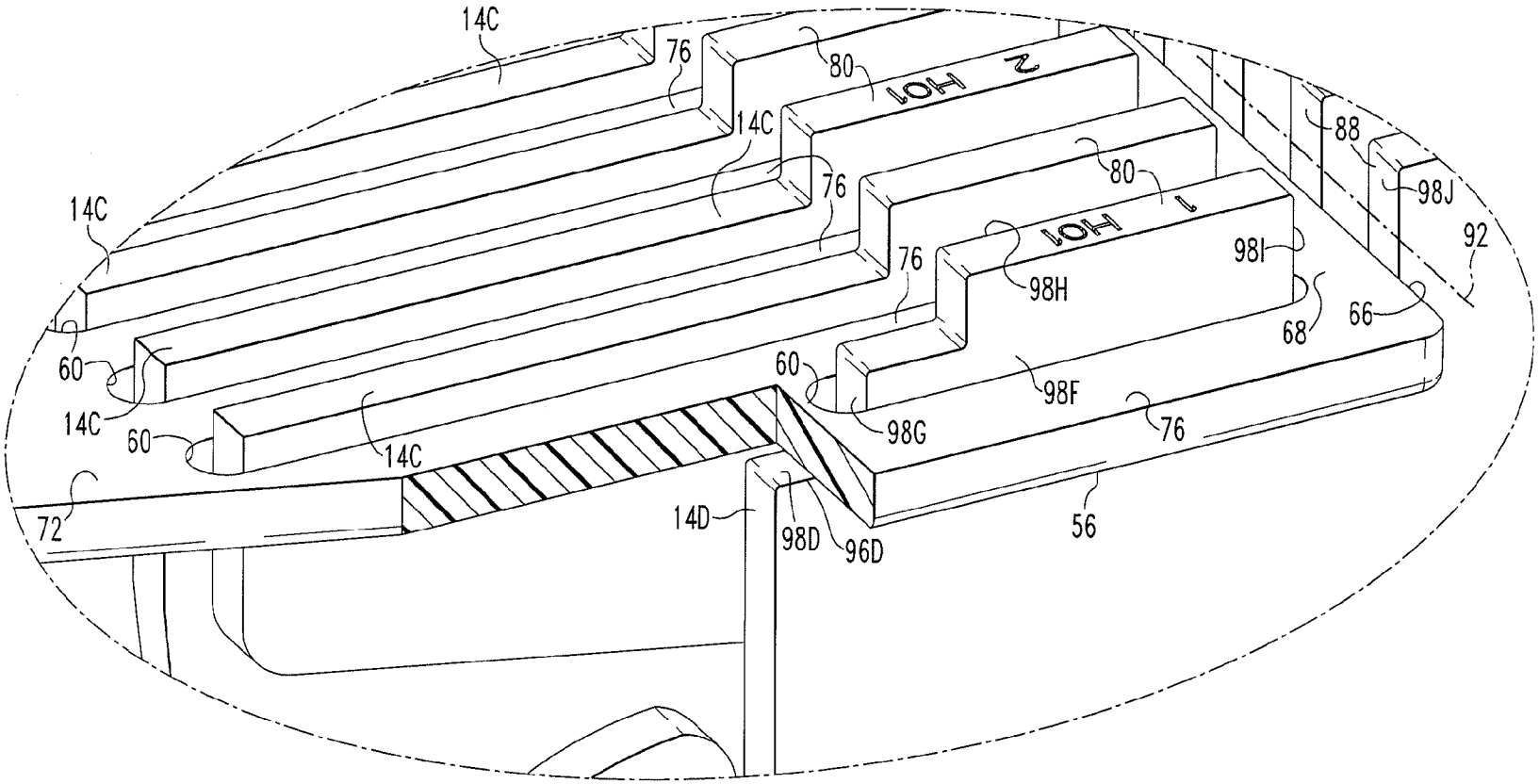

As can be understood from FIGS. 3 and 4, the arc chute 4 comprises a plurality of arc plates that are collectively referred to with the numeral 14, and further comprises a support apparatus 16 and an arc horn 20. The arc chute 4 advantageously also comprises a shield apparatus 24 that is retained between portions of the arc plates 14 and portions of the support apparatus 16 in order to retain the shield apparatus 24 in place without the use of adhesives or separate support structures. The shield apparatus 24 provides protection to the support apparatus 16 by generating gases in the event of an arc that help to extinguish the arc and to thereby resist damage to the support apparatus 16 during an arc event.

The arc plates 14 include a first arc plate 14A that is disposed adjacent the arc horn 20, a second arc plate 14B that is disposed adjacent the first arc plate 14A, a plurality of intermediate arc plates 14C, and a last arc plate 14D that is disposed at the opposite end of the arc chute 4 from the first arc plate 14A. The arc plates 14 are formed of an electrically conductive material and, in conjunction with the arc horn 20 and the shield apparatus 24, are configured to break up, disperse, and extinguish an electrical arc during an arc event that may occur contemporaneous with separation of the separable contacts 12.

The support apparatus 16 includes a pair of side supports 28 and an end support 32 which, in the exemplary embodiment depicted herein, are formed of a thermosetting resin material. The side supports 28 each have a plurality of receptacles 36 formed therein that are structured to receive portions of the arc plates 14 and the arc horn 20. The end support 32 has a plurality of elongated apertures 40 formed therein through which gases are vented during an arc event. The support apparatus 16 further can include a pair of pins 44 that are received in holes 46 to hold the support apparatus 16 together along with the arc plates 14, the arc horn 20, and the shield apparatus 24. When assembled, the pins 44 are received in the holes 46 and the ends are deformed in order to cause the pins 44 to remain fixed within the holes 46. When the arc chute 4 is fully assembled, a pair of lugs 48 formed on the end support 32 are received in corresponding sockets 52 formed in the side supports 28.

The shield apparatus 24 includes a pair of shield members 56 each have a plurality of parallel elongated openings 60 formed therein. Each elongated opening 60 terminates at a termination 64 that is spaced a predetermined distance from a common edge 66 of the shield member 56. The existence of the elongated openings 60 in the shield members 56 thus causes the shield members 56 to each include a base portion 68, an end portion 72 opposite the base portion 68, and a plurality of elongated ribs 76 extending between the base portion 68 and the end portion 72 and along the elongated openings 60.

Each arc plate 14 includes a pair of protrusions 80 extending in opposite directions therefrom. The arc horn 20 likewise has a pair of protrusions 84 protruding therefrom. The protrusions 80 of the arc plates 14 each have a notch 88 formed therein, and the notches 88 are aligned with one another such that the notches 88 together form and define a pair of open channels 92 which each face generally toward the receptacles 36 of one of the pair side supports 28. It can be seen that the protrusions 84 of the arc horn 20 do not have a notch formed therein, although a notch potentially could be provided therein in other embodiments (not expressly depicted herein).

As can be best understood from FIG. 4, the shield members 56 are received on the arc plates 14 and are retained between portions of the arc plates 14 and the side supports 28. More particularly, the base portion 68 is received in the open channel 92, and elongated portions of the protrusions 80 that are disposed adjacent the notches 88 that are formed in the arc plates 14 are received in the elongated openings 60. It thus can be understood that the elongated ribs 76 of the shield members 52 are disposed generally between adjacent pairs of arc plates 14 and thus protect the side supports 28 to resist damage thereto during an arc event. The shield members 56 are advantageously formed of a cellulose-filled melamine (CFM) material or other material which, in the presence of an electrical arc, generates gases that are inert and that cool the arc, thus facilitating the extinguishment of the arc.

As can be best understood from FIGS. 3-5, the arc plates 14A and 14D each include a pair of support 96A and 96D that are engageable with the shield members 56 and that retain the shield members 56 in their locations adjacent the side supports 28. In this regard it is noted that the arc plate 14B likewise includes such a support, but the support is hidden from view in the accompanying drawings. The supports 96A and 96D each include an engagement surface 98A and 98D, respectively, that is engageable with a portion of the shield member 56 at a location adjacent an end of one of the elongated openings 60. In this regard, it is understood that the bases of the notches 88 each serve as a further support 96E that each provide a further engagement surface 98E (as is shown in FIG. 3) that is likewise engageable with a portion of the shield member 56 adjacent the terminations 64 of the elongated openings 60. It thus can be understood that the engagement surfaces 98A and 98D of the arc plates 14A and 14D (and the engagement surface of the arc plate 14B that is hidden from view), as well as the engagement surfaces 98E of all of the arc plates 14, retain the shield members 56 between such engagement surfaces 98A, 98D, and 98E of the various arc plates 14 and the confronting faces of the side supports 28. Since the protrusions 80 of the arc plates 14 are received in the receptacles 36 of the side supports 28, the shield members 56 are trapped and are thus retained between portions of the arc plates 14 and portions of the side supports 28 without the use of adhesives or separate fastening structures such as screws, clips, and the like. Such a configuration also enables the side supports 28 to be formed of a relatively inexpensive thermosetting resin material that otherwise might have limited resistance to an arc.

While the engagement surfaces 98A, 98D, and 98E each face generally toward the side supports 28 and thus provide support to the shield members 56 in a direction generally directly between the arc plates 14 and the side supports 28, it can be understood from FIGS. 4 and 5 that the protrusions 80 of the arc plates 14 provide additional engagement surfaces that retain the shield members 56 in their protective position. For instance, the portions of the protrusions 80 that extend through the elongated openings 60 each further provide additional engagement surfaces 98F, 98G, 98H, and 98I. The notches 88 further provide additional engagement surface 98J. All of the engagement surfaces 98F, 98G, 98H, 98I, and 98J are engageable with the shield members 56 to provide retention of the shield members 56 in directions generally parallel with the plane of the shield members 56 to retain the shield members 56 in their protective position with respect to the side supports 28.

In this regard, it is understood that the engagement surfaces 98A, 98D, 98E, 98F, 98G, 98H, 98I, and 98J are each engageable with the shield members 56 to retain the shield members 56 in their protective position with respect to the side supports 28, but this is not to say that all such engagement surfaces 98A, 98D, 98E, 98F, 98G, 98H, 98I, and 98J are simultaneously engaged with the shield members 56. Rather, the shield members 56 can be configured to permit a slight degree of movement of the shield members 56 with respect to the side supports 28 while still retaining the shield members 56 in a protective position with respect to the side supports 28 whereby they can generate protective gases during an arc event to resist damage to the side supports 28. By permitting a certain amount of movement between the shield members 56 and the arc plates 14, the shield members 56 can be manufactured to relatively less exacting dimensions, which can reduce costs. Since the shield members 56 are retained without the use of adhesives or separate attaching structures, further cost savings is achievable, and reliability of the placement and retention of the shield members 56 is enhanced. Moreover, the cost of assembly of the arc chute 4 is reduced due to the avoidance of the effort that otherwise would be required to apply such an adhesive or separate attaching structure such as a fastener to the shield member 56, the side supports 28, or both.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An arc extinction apparatus for use in a circuit interrupter, the arc extinction apparatus comprising:

a plurality of arc plates;

a support apparatus having a number of receptacles formed therein;

at least a first shield member having a plurality of openings formed therein and being structured to generate gases in the presence of an electrical arc;

at least a portion of at least some of the arc plates being engaged with the at least first shield member to retain the at least first shield member between the at least portion of the at least some of the arc plates and at least a portion of the support apparatus; and a portion of an arc plate of the plurality of arc plates being received in an opening of the plurality of openings and also being received in a receptacle of the number of receptacles.

2. The arc extinction apparatus of claim 1 wherein at least a first arc plate of the plurality of arc plates comprises a support that is engageable with the at least first shield member and that comprises an engagement surface of which at least a portion faces generally toward the at least portion of the support apparatus.

3. The arc extinction apparatus of claim 2 wherein the plurality of arc plates further comprise at least a pair of additional supports, one or more additional supports of the at least pair of additional supports being disposed on at least a first arc plate of the plurality of arc plates, the at least pair of additional supports each being engageable with the at least first shield member and comprising an additional engagement surface, at least a pair of the additional engagement surfaces facing generally away from one another.

4. The arc extinction apparatus of claim 1 wherein at least some of the arc plates of the plurality of arc plates each have a notch formed therein, the notches being situated to form a generally open channel along the at least some of the arc plates that faces generally toward the at least portion of the support apparatus, at least a portion of the at least first shield member being received in at least a portion of the channel.

5. The arc extinction apparatus of claim 1 wherein the at least first shield member has a plurality of parallel elongated openings formed therein that each terminate at a termination that is spaced a predetermined distance from a common edge of the at least first shield member such that the at least first shield member comprises:

a base portion situated between the edge of the at least first shield member and the terminations, and a plurality of elongated ribs disposed adjacent the openings and extending from the base portion.

6. The arc extinction apparatus of claim 5 wherein at least some of the arc plates of the plurality of arc plates each have a notch formed therein, the notches being situated to form a generally open channel, at least a portion of the base portion being received in the channel.

7. The arc extinction apparatus of claim 6 wherein elongated portions of a number of the arc plates disposed adjacent the notches formed therein are received in the elongated openings.

8. The arc extinction apparatus of claim 7 wherein at least a first arc plate of the plurality of arc plates comprises a support that is disposed adjacent the elongated portion and that in engageable with the at least first shield member adjacent one of the elongated openings opposite its termination at the base portion to retain at least a portion of the at least first shield member between the support and the at least portion of the support apparatus.

9. A circuit interrupter comprising:

a line terminal;

a load terminal;

a set of separable contacts; and an arc extinction apparatus that comprises:

a plurality of arc plates, a support apparatus having a number of receptacles fanned therein, at least a first shield member having a plurality of openings formed therein and being structured to generate gases in the presence of an electrical arc, at least a portion of at least some of the arc plates being engaged with the at least first shield member to retain the at least first shield member between the at least portion of the at least some of the arc plates and at least a portion of the support apparatus, and a portion of an arc plate of the plurality of arc plates being received in an opening of the plurality of openings and also being received in a receptacle of the number of receptacles.

10. The circuit interrupter of claim 9 wherein at least a first arc plate of the plurality of arc plates comprises a support that is engageable with the at least first shield member and that comprises an engagement surface of which at least a portion faces generally toward the at least portion of the support apparatus.

11. The circuit interrupter of claim 10 wherein the plurality of arc plates further comprise at least a pair of additional supports, one or more additional supports of the at least pair of additional supports being disposed on at least a first arc plate of the plurality of arc plates, the at least pair of additional supports each being engageable with the at least first shield member and comprising an additional engagement surface, at least a pair of the additional engagement surfaces facing generally away from one another.

12. The circuit interrupter of claim 9 wherein at least some of the arc plates of the plurality of arc plates each have a notch formed therein, the notches being situated to form a generally open channel along the at least some of the arc plates that faces generally toward the at least portion of the support apparatus, at least a portion of the at least first shield member being received in at least a portion of the channel.

13. The circuit interrupter of claim 9 wherein the at least first shield member has a plurality of parallel elongated openings formed therein that each terminate at a temination that is spaced a predetermined distance from a common edge of the at least first shield member such that the at least first shield member comprises:

a base portion situated between the edge of the at least first shield member and the terminations, and a plurality of elongated ribs disposed adjacent the openings and extending from the base portion.

14. The circuit interrupter of claim 13 wherein at least some of the arc plates of the plurality of arc plates each have a notch formed therein, the notches being situated to form a generally open channel, at least a portion of the base portion being received in the channel.

15. The circuit interrupter of claim 14 wherein elongated portions of a number of the arc plates disposed adjacent the notches formed therein are received in the elongated openings.

16. The circuit interrupter of claim 15 wherein at least a first arc plate of the plurality of arc plates comprises a support that is disposed adjacent the elongated portion and that in engageable with the at least first shield member adjacent one of the elongated openings opposite its termination at the base portion to retain at least a portion of the at least first shield member between the support and the at least portion of the support apparatus.

* * * * *